United States Patent [19]

Swank

[11] Patent Number: 5,064,394

[45] Date of Patent: Nov. 12, 1991

[54] METHOD OF FORMING A SHRINKFIT IMPLOSION PROTECTION BAND HAVING A CONCAVITY THEREIN

[75] Inventor: Harry R. Swank, Lancaster, Pa.

[73] Assignee: Thomson Consumer Electronics, Inc., Indianapolis, Ind.

[21] Appl. No.: 533,638

[22] Filed: Jun. 5, 1990

[51] Int. Cl.[5] ..... H01J 29/87; H01J 9/24

[52] U.S. Cl. ..... 445/8; 358/246

[58] Field of Search ..... 445/8; 358/246

[56] References Cited

U.S. PATENT DOCUMENTS

| | | | |
|---|---|---|---|
| 3,317,172 | 5/1967 | Balint | 358/246 X |
| 3,623,196 | 11/1971 | Bongenaar et al. | 358/246 X |
| 4,222,075 | 9/1980 | Mitchell | 358/246 |
| 4,360,837 | 11/1982 | Kreidler | 358/246 |
| 4,459,735 | 7/1985 | Sawdon | 29/509 |
| 4,641,196 | 2/1987 | Musha et al. | 358/246 |
| 4,757,609 | 7/1988 | Sawdon | 29/798 |

FOREIGN PATENT DOCUMENTS

| | | | |
|---|---|---|---|
| 111935 | 7/1982 | Japan | 358/246 |

*Primary Examiner*—Kenneth J. Ramsey

*Attorney, Agent, or Firm*—Joseph S. Tripoli; Dennis H. Irlbeck; Vincent J. Coughlin, Jr.

[57] ABSTRACT

A method of forming an implosion protection band for a substantially rectangular CRT is disclosed. The band has at least one mounting lug comprising a base portion and an attachment portion cooperating therewith. The method includes the steps of expanding the dimensions of the band to form at least one outwardly directed concavity therein to accommodate the base portion of the mounting lug to prevent the lateral displacement thereof, attaching the mounting lug to the band and affixing the band to the CRT to compressively force the band and the base portion of the lug against the CRT.

14 Claims, 6 Drawing Sheets

METHOD OF FORMING A SHRINKFIT IMPLOSION PROTECTION BAND HAVING A CONCAVITY THEREIN

BACKGROUND

This invention relates generally to implosion protection bands for cathode-ray tubes (CRTs) and particularly to a method of forming a shrinkfit implosion protection band.

A cathode-ray tube is evacuated to a very low internal pressure and accordingly is subject to the possibility of implosion due to the stresses produced by atmospheric pressure acting on all surfaces of the tube. This problem has been addressed in the art by providing the CRT with an implosion protection band. Such a band is used to apply a compressive force to the sidewall of the CRT to redistribute some of the faceplate forces. The redistribution of the faceplate forces decreases the probability of an implosion of the tube by minimizing tension in the corners of the faceplate. An implosion protection band is also beneficial because it improves the impact resistance of the tube. Glass in compression is stronger than glass which is in tension and the band causes compression in faceplate areas which otherwise would be in tension. Additionally, in the event of an implosion the redistributed stresses cause the imploding glass to be directed toward the back of the cabinet in which the tube is mounted, thereby substantially reducing the probability of someone in the vicinity of the imploding tube being injured..

An implosion protection band of the shrinkfit type typically is manufactured by forming a strip of steel into a loop having the same configuration as the faceplate to be protected and joining the two ends of the strip on one side of the band. In some instances, the band is made by joining two identical strips on two sides to form the loop. For both types of bands, the periphery of the loop is slightly smaller than the periphery of the faceplate. The loop is heated to approximately 300° to 500° C. and the coefficient of expansion of the material causes the loop to expand to dimensions permitting the loop to be slipped around the sides of the faceplate. As the band cools it shrinks and tightly surrounds the faceplate, thereby applying the necessary implosion protection compression to the faceplate sidewall. The compressive force can be accurately controlled by exceeding the yield point of the metal in the band.

The ends of the strips are permanently joined by either welding or crimping. In either event, because the strip is used to apply substantial pressure to the sidewall of the tube, it is essential that the joint formed when the two ends are coupled together be sufficiently strong to withstand the pressure. It is therefore important to test the integrity of the joint prior to applying the band to a CRT. It is also important to prepare the loop in a manner which assures that the loop will properly seat on to the sidewall of the CRT and will apply optimum compressive forces to the CRT. Additionally, it is necessary that where mounting lugs are attached to the band for securing the tube within a receiver, the lugs cooperate with the band to improve the integrity thereof. The present invention fulfills these important criteria.

SUMMARY

A method is disclosed for forming implosion protection means for a substantially rectangular CRT where the implosion protection means has at least one mounting means having a base portion and an attachment portion cooperating therewith. The method includes expanding the dimensions of the implosion protection means to form at least one outwardly directed concavity therein to accommodate the base portion of the mounting means to prevent the lateral displacement thereof. The base portion of the mounting means then is attached to the implosion protection means which is affixed to the CRT to compressively force the implosion protection means and the base portion of the mounting means against the CRT.

DETAILED DESCRIPTION OF THE PREFERRED EMBODIMENTS

Figure 1:
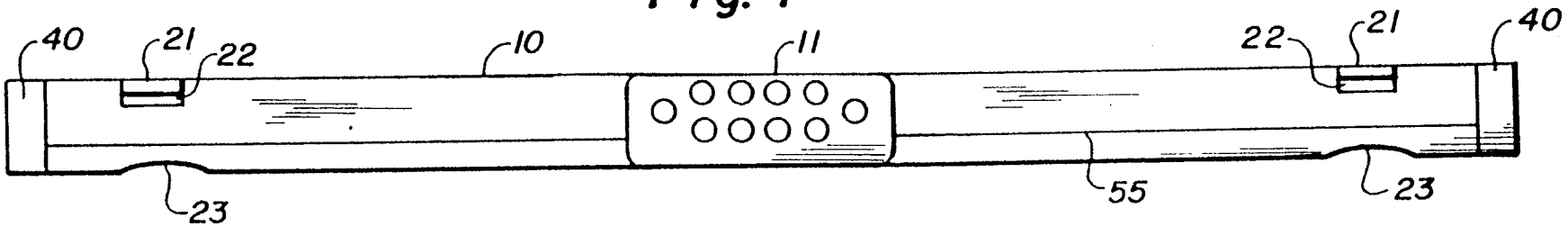
FIG. 1 is a side view of a preferred embodiment.
Figure 2:
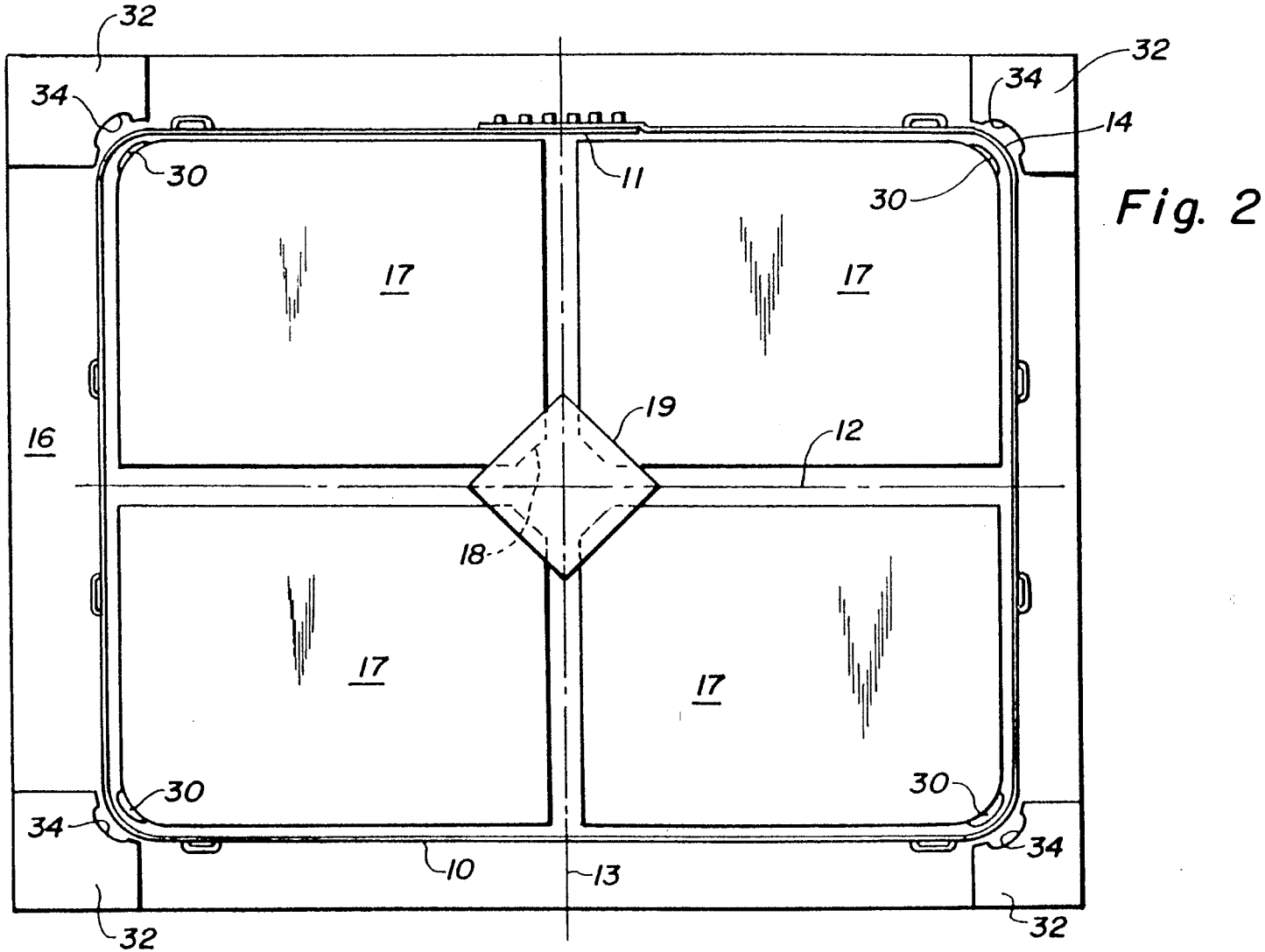
FIG. 2 is a top view of the preferred embodiment of FIG. 1 including a simplified showing of apparatus for stretching and forming the shrinkfit band.

In FIGS. 1 and 2, a shrinkfit band 10 is formed by joining together the ends of at least one steel strip at a joint, 11. Crimping is the illustrated technique and is performed in a manner described in U.S. Pat. Nos. 4,459,735 and 4,757,609; although welding also may be used. After the ends are joined, the shrinkfit band 10 is in the form of a substantially rectangular loop having a major axis 12 and a minor axis 13. The dimensions of the major and minor axes, and thus also the periphery of the band, are slightly less than the corresponding dimensions of a substantially rectangular cathode-ray tube to which the band will be applied. The band has rounded corners 14. It has been found that the band seats on the tube and applies optimum compressive forces to the sidewall of the tube when the inside radius of the corners 14 of the band is substantially equal to the outside radius of the corners of the faceplate. Typically a tape having an adhesive on both sides is applied to the sidewall of the tube where the band is to be located. The tape adds to the adherence of the band at the corners and thus helps to maximize the tension along the sides of the band. Accordingly, as the band 10 shrinks, optimum compressive forces are applied to the corners of the tube and the band more uniformly contacts the entire tube.

Figure 3:
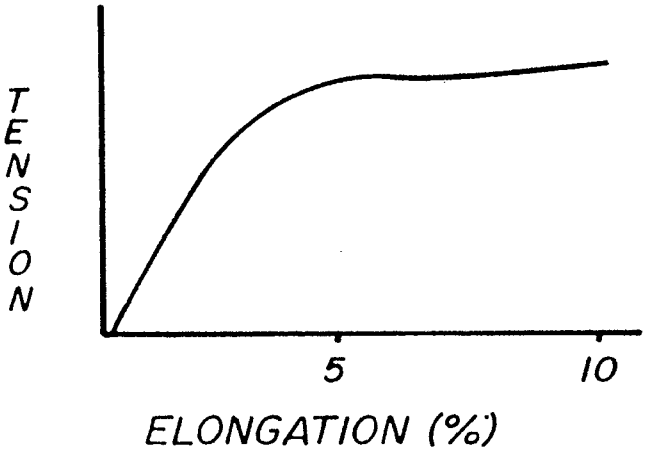
FIG. 3 is a typical elongation curve for a material from which the band can be made.

It has also been learned that it is advantageous to stretch the band 10 to slightly exceed the elastic limit of the metal thereby causing the metal to yield in predetermined areas. Several advantages are realized by such prestressing of the band material beyond the elastic limit. The material has already yielded and thus will apply a known predictable tension to the tube. This is evident from FIG. 3 which shows that the tension remains substantially constant after approximately 5% elongation. Also, the stretching verifies the integrity of the joint 11. The stretching also forms a necked down area 23 which serves as proof that the joint 11 was tested.

Figure 4:
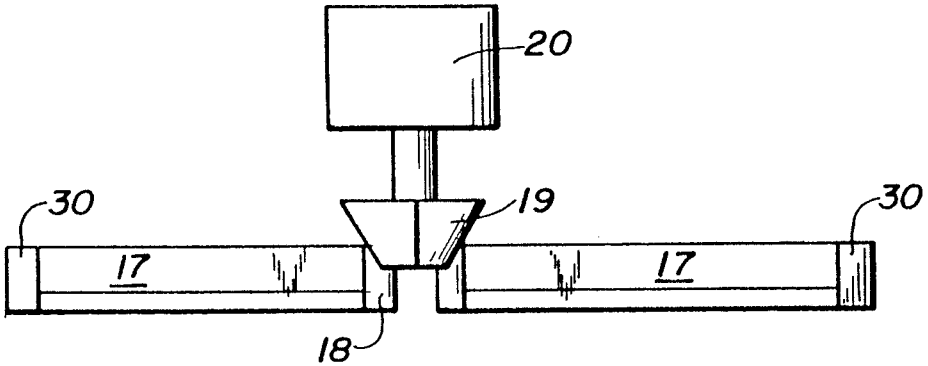
FIG. 4 is a simplified side view of the stretching and forming apparatus.

FIGS. 2 and 4 are simplified showings of equipment which can be used to stretch the band 10 in order to realize the above enumerated advantages. The shrinkfit band 10 is supported in some convenient manner, such as by a support 16. A plurality of plates 17 are arranged to lie within the loop 10.

The plates 17 are slideably affixed to the support 16, and are slideable in directions parallel to the diagonals of the apparatus, and thus to those of the band 10 after it is formed. The plates 17 are each shaped as one quarter of the band and thus form and dimension the band as desired. The plates are spaced apart a small distance and can have a corner removed to form a bevel 18. The bevels are parallel to the diagonals of the apparatus. A wedge 19 is arranged between the bevels 18 and is urged against the plates 17 by a cylinder 20. Actuation of the cylinder 20 urges the wedge 19 between the plates and causes the plates to move against, stretch and shape the band 10. The travel distance of the plates 17 is accurately established by controlling the stroke of the cylinder 20. The band 10 is thus laid around the plates 17 and the cylinder 19 is actuated to move the plates a distance sufficient to stretch the band material by 1.0% to 1.5%. After the band is stretched, the cylinder is retracted and the band is removed from the apparatus. The band 10 is thus formed into the desired shape and the inside radius of the corners of the band is substantially equal to the outside radius of the corners of the tube upon which the band will be fitted.

Band 10 includes hooks, or lances 21, which are provided on both sides of the band. The lances 21 are used to connect degaussing coils and other apparatus necessary for the operation of the tube to the outside of the tube. The lances 21 are arranged along one edge of the band 10 and small cutout portions 22 lie adjacent each of the lances. Accordingly, when the band 10 is stretched, necked down areas 23 are formed in the band immediately adjacent to the lances 21. The formation of the necked down areas is advantageous for several reasons. Firstly, they are direct evidence that the integrity of the joint 11 has been tested by the stretching of the band after the formation of the joint. Also, the necked down areas can be used as a test to verify that the stretching has been done. In such a test the band 10 is laid on a lighted table with the necked down areas 23 laying on the table and the lances facing upwardly. The necked down areas are then immediately visible as a verification that the joint 11 has been tested for integrity and the absence of the necked down areas 23 results in rejection of the band. In FIGURE 1 the necked down areas 23 are exaggerated for convenience of illustration. However, the areas are visually evident in bands applied to the CRT's and thus serve as evidence that the band has been properly formed and tested.

As described above, the shrinkfit band 10 is identical to that disclosed in copending U.S. patent application, Ser. No. 443,524 filed on Nov. 30, 1989 by H. R. Swank and entitled, "Method of Forming A Shrink Fit Implosion Protection Band". The present method is an improvement over the prior method since the present method permits at least one and preferably four outwardly directed concavities 40 to be formed in the band 10 for a purpose to be described hereinafter.

Figure 5:
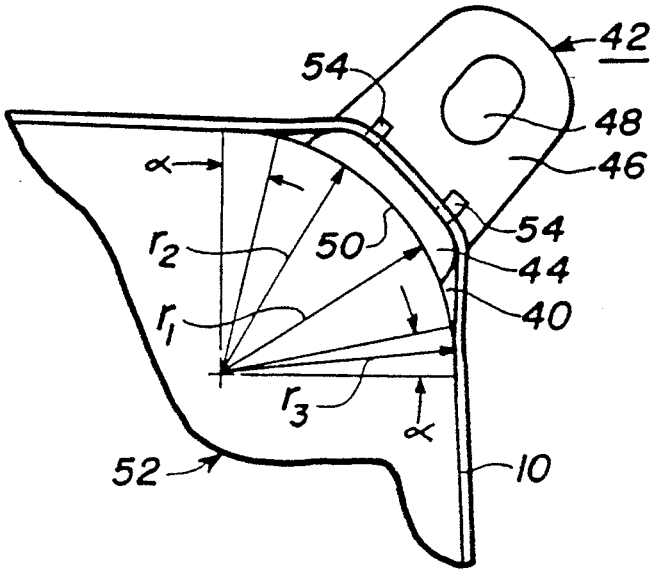
FIG. 5 is a front view of a segment of a CRT showing the preferred embodiment.

With reference to FIG. 2, four bosses 30 having a substantially arcuately-shaped outer surface are provided on the corners of the plates 17 which lie along the diagonals of the apparatus. Four dies 32, each having a boss-receiving recess 34, are attached to the corners of the support 16. As the plates 17 are moved to stretch the band 10, the bosses 30 force the contacted portions of the band into the recesses 34 forming the outwardly directed concavities 40 in the corners of the band 10. The concavities 40 preferably, but not necessarily, extend across the width of the band 10. With reference to FIGURE 5, a mounting lug 42, having a base portion 44 and an upstanding attachment portion 46 to facilitate attachment to a receiver cabinet (not shown), is associated with each of the concavities 40. The attachment portion 46 has an aperture 48 therethrough. The base portion 44 of the mounting lug 42 is disposed within the concavity 40 to prevent lateral displacement of the lug. Typically, the band 10 has a thickness of about 1.6 mm and the lug 42 has a thickness within the range of 2.0 to 3.2 mm and a strength which is sufficient to withstand or avoid distortion if the tube is dropped. The lugs are preferably made of quarter-hard, cold rolled steel. The base portion 44 of the lug 42 has a radius of curvature, $r_1$, which conforms to, i.e., is substantially equal to, the radius of curvature, $r_2$, of a corner 50 of a faceplate panel 52. The base portion 44 of the mounting lug 42 is attached, for example by mechanical crimping or welding, to the overlying shrinkfit band 10. The means of attachment is selected to provide a smooth contact surface with the glass sidewall of the faceplate panel. The preferred method of attachment is by means of at least one mechanical crimp 54; however, two spaced-apart rows of crimps with two or more crimps in each row are preferred to interlock the overlapping materials. The crimps 54 also are formed in the manner described in U.S. Pat. Nos. 4,459,735 and 4,757,609. The lugs 42 are attached within the concavities 40 before the band 10 is fitted onto the tube. The positioning of the lugs 42 under the band 10 also prevents the lugs from being detached from the band during attachment to, and subsequent handling of, the receiver cabinet.

The shrinkfit band 10 is heated to about 300° to 500° C. to expand the band to dimensions greater than those of the faceplate. Cooling of the band 10 compressively forces the base portion 44 of the mounting lug 42 against the corner 50 of the sidewall. The concavities 40 overlie at least a portion of the corners 50 and are formed to closely conform to the shape of the base portions 44 of the mounting lugs 42. Additionally, a bend 55 (shown in FIGURE 1), formed during the manufacturing of the steel strip, extends circumferentially around the band 10. The bend 55 ensures that the edges of the band contact the sidewall so that the conforming portions of the shrinkfit band, having the radius of curvature, $r_3$, contact the given radius of curvature $r_2$, of the corners of the sidewall immediately adjacent each of the concavities 40, thereby maximizing the contact between the band and the sidewall. Such a structure compressively forces the band against at least a portion of each corner 50 along the arcs having the angles $\alpha$. This configuration of the band 10 and the mounting lugs 42 assures that the band and the lugs compressively contact each of the corners 50 of the faceplate panel 52 along substantially the entire corner of the panel.

Alternatively, the concavities 40 may be formed in the band 10 by modifying the plates 17 of the apparatus shown in FIG. 2, to accommodate a mounting lug 42 on each of the corners rather than the bosses 30. The base 44 of the mounting lug is then used as a tool to form each of the concavities. No modification of the dies 32 is required.

Figure 6:
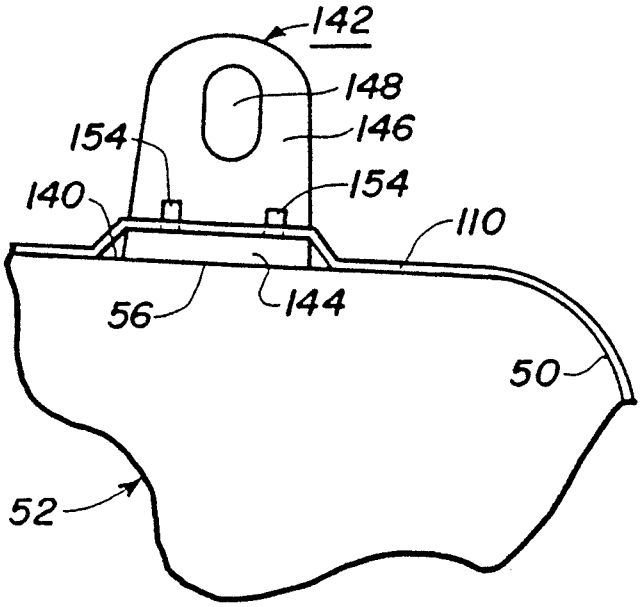
FIG. 6 is a front view of a segment of a CRT showing a second embodiment.
Figure 7:
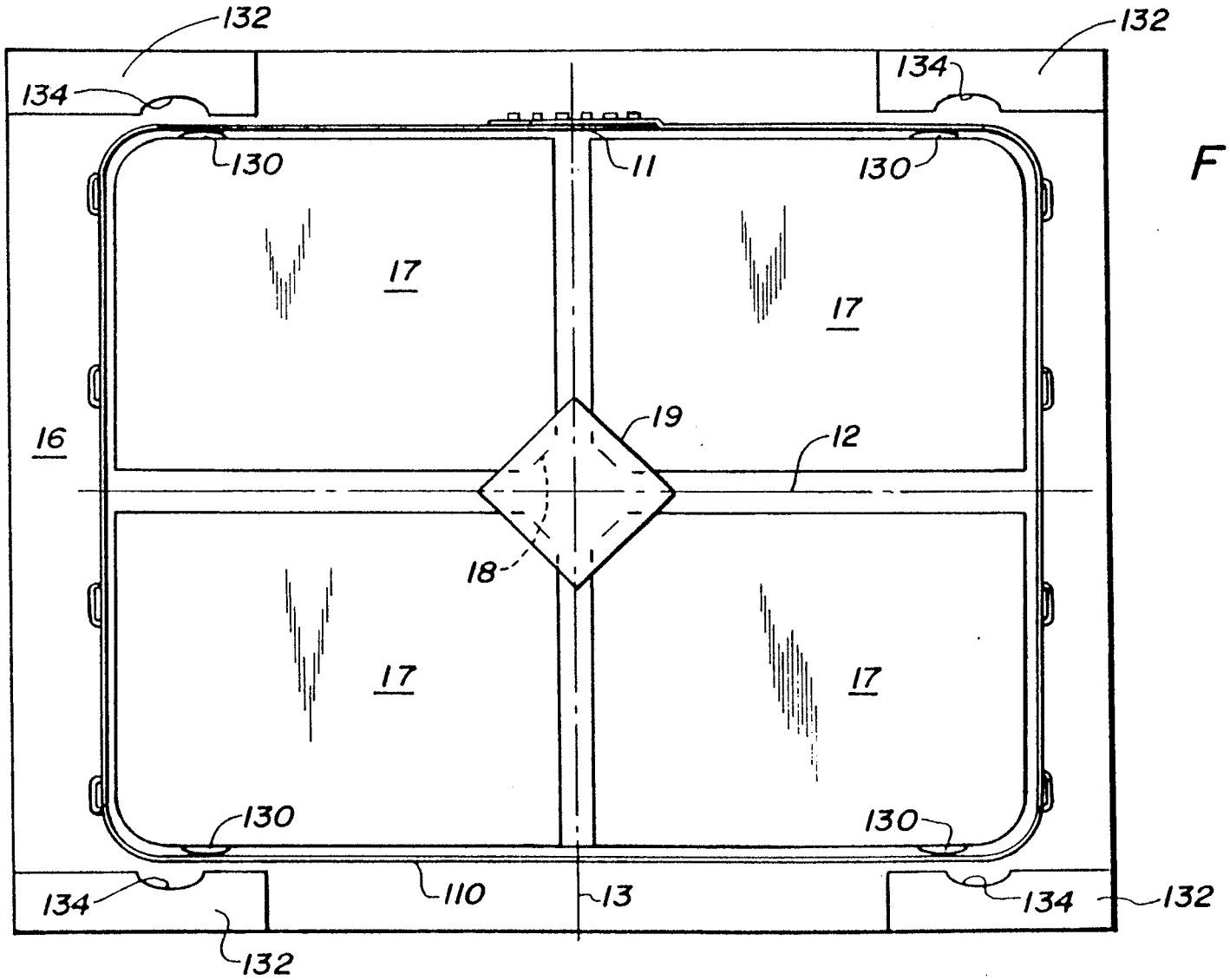
FIG. 7 is a top view of the second embodiment of a simplified apparatus for stretching and forming the shrinkfit band.

A second embodiment of an implosion protection shrinkfit band 110 is shown in FIGS. 6 and 7. The shrinkfit band 110 is similar to the shrinkfit band 10 in all respects, except that a plurality of concavities 140 are formed in the portions of the shrinkfit band that overlie flattened portions 56 of the sidewall 20 of the faceplate panel 52 rather than in the corners 50. Two concavities 140 are formed in each of the oppositely disposed long sides of the band 110. Preferably, the concavities are centered a distance of about 2.5 to 7.6 cm from the corners of the faceplate panel.

With reference to FIG. 7, four bosses 130, each having a substantially arcuately-shaped outer surface are provided on the outer long sides of the plates 17. Four dies 132, each having a boss receiving recess 134, are attached along the oppositely disposed long sides of the support 16. As the plates are moved to stretch the band 110, the bosses 130 force the contacted portions of the band into the recesses 134 forming the outwardly directed concavities 140 in the long sides of the band.

Again with reference to FIG. 6, the mounting lugs 142 are similar to the lugs 42 and include a base portion 144 with an upstanding attachment portion 146 having an aperture 148 therethrough to facilitate attachment to the receiver cabinet. The base portion 144 of the mounting lug 142 is disposed within the concavity 140 to prevent lateral displacement of the lug 142. The base portion 144 is attached to the overlying band 110 by, for example, mechanical crimping or welding. The preferred method of attachment is by means of at least one mechanical crimp 154, although two spaced-apart rows of crimps with two or more crimps in each row are preferred to interlock the overlapping materials. The base portion 144 of the lug 142 is substantially flat where it contacts the flattened portions 56 of the sidewall. As described above, when the shrinkfit band 110 is disposed around the sidewall and begins to cool, the corners of the band seat first and then the rest of the band settles against the flattened portions 56 of the sidewall 20. The concavities 140 are formed to closely conform to the shape of the base portions 144. A bend (not shown) preformed in the band 10, similar to the bend 55 preformed in the band 10, also ensures that the edges of the band contact the surface of the sidewall immediately adjacent each of the concavities 140 to compressively force the base portions 144 of the mounting lugs 142 and the band 110 against the flattened portions of the sidewall.

The concavities 140 also may be formed by using the mounting lugs 142 attached to the long sides of the plates 17, rather than the bosses 130, in a manner similar to that described with respect to the first embodiment. No modification of the dies 132 is required.

Figure 8:
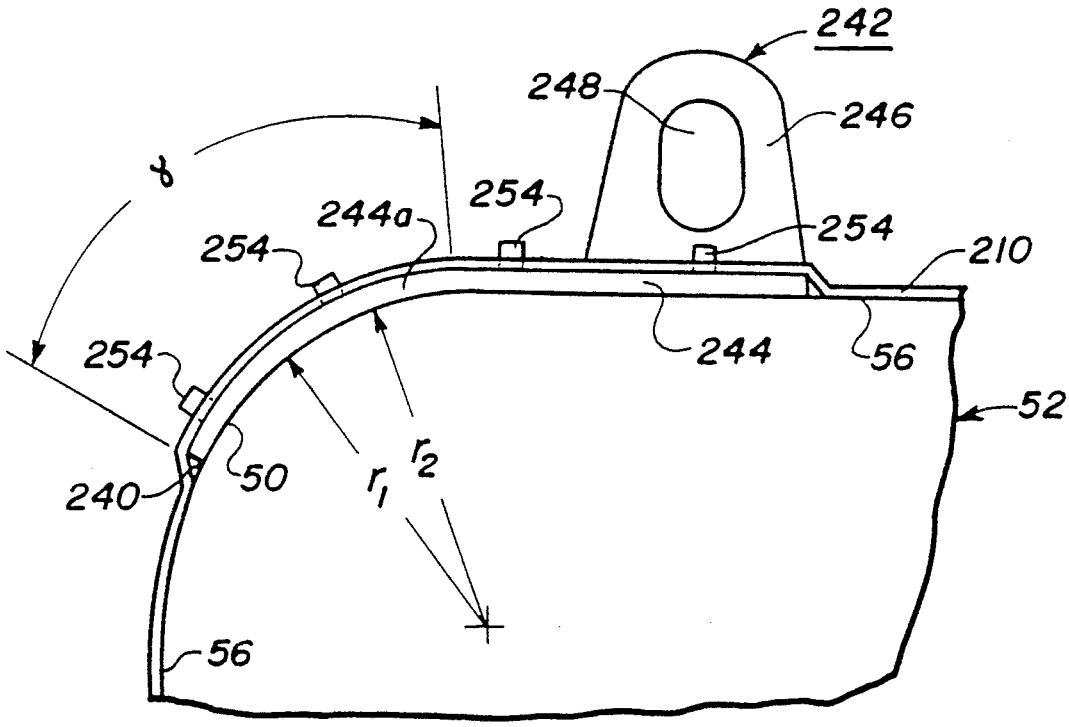
FIG. 8 is a front view of a segment of a CRT showing a third embodiment.
Figure 9:
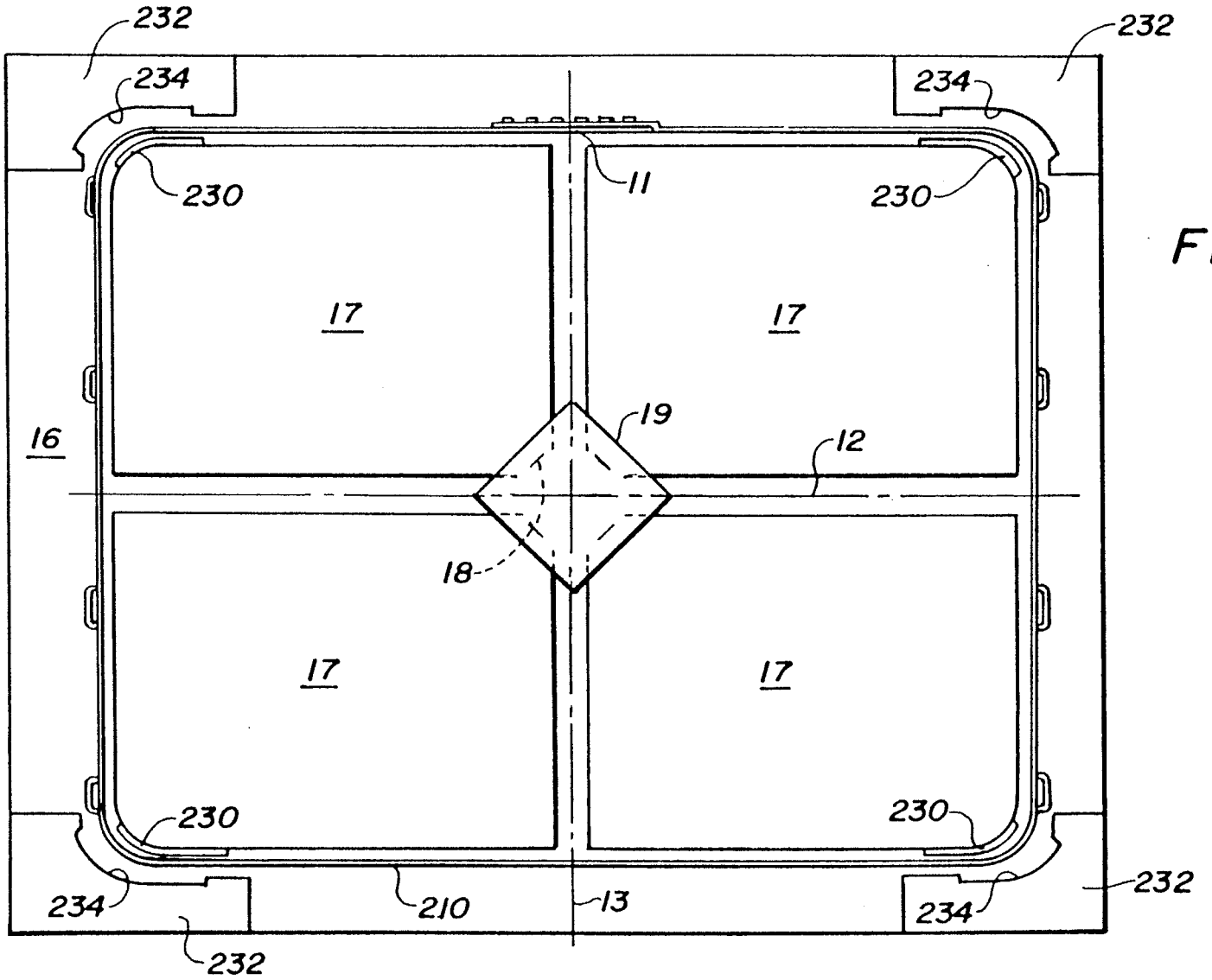
FIG. 9 is a top view of the third embodiment of a simplified apparatus for stretching and forming the shrinkfit band.

A third embodiment of an implosion protection shrinkfit band 210 is shown in FIGS. 8 and 9. The shrinkfit band 210 is similar to bands 10 and 110 in all respects, except that a plurality of concavities 240 are formed in the portions of the shrinkfit band that overlie at least a portion of each of the corners 50 and adjacent sections of the flattened portions 56 of the sidewall, along the long sides of the band. The portions of the concavities 240 formed in each of the oppositely disposed long sides of the band 210 are centered a distance of about 2.5 to 7.6 cm from the corners of the panel.

With reference to FIG. 9, four bosses 230, each having a substantially arcuately-shaped outer surface are provided around at least a portion of the corners and along a section of the long sides of the plates 17. Four dies 232, each having a boss-receiving recess 234, are attached to the corners and along the oppositely disposed long sides of the support 16. As the plates are moved to stretch the band 210, the bosses 230 force the contacted portions of the band into the recesses 234 forming the outwardly directed concavities 240.

With reference to FIG. 8, a base portion 244 of a mounting lug 242 includes a shoulder projection **244*a* which extends through an arc, $\gamma$, of about 75 degrees or greater. The base portion 244 is disposed between the shrinkfit band 210 and the sidewall 20 of the faceplate panel 52. In order to maximize the contact between the shrinkfit implosion protection band and the sidewall of the faceplate panel, the concavities 240 (only one of which is shown) are formed in the band 210 to accommodate the base portions 244 and shoulder projections 244*a* of the mounting lugs and to prevent the lateral displacement thereof. The concavities 240 are configured to closely conform to the base portions 244 and shoulder projections 244*a* of the mounting lugs 242. Additionally, a bend (not shown) is preformed in the band 210 to ensure that the edges of the band contact the given radius of curvature of the corners 50 of the sidewall and the flattened portions of the sidewall immediately adjacent the concavities 240 thereby maximizing the contact between the shrinkfit band 210 and the sidewall of the faceplate panel 52. Preferably, the concavities 240 extend across the width of the band. The base portions 244 and shoulder projections 244*a* are secured to the overlying band 210 by welding or by at least one, but preferably a plurality of mechanical crimps 254, arranged in two spaced-apart rows, which interlock the overlapping materials. Since the mounting lugs 242 are disposed under the band 210, the radius of curvature, $r_1$, of the arcuate shoulder projection 244*a* is equal to the radius of curvature, $r_2$, of the corner 50 of the faceplate panel 52. The attachment portions 246 of the lugs 242 are located along the flattened portions 56** of the long sides of the sidewall.

What is claimed is:

1. A method of forming a shrinkfit implosion protection band for a substantially rectangular CRT having a faceplate panel including a peripheral sidewall, said sidewall having corners with a given radius of curvature extending into flattened portions, a plurality of mounting lugs being disposed between said inner surface of said shrinkfit band and said sidewall, each of said mounting lugs having a base portion and an attachment portion, said method comprising the steps of:

1) forming said band by joining together the ends of at least one strip of material into a substantially rectangular loop having dimensions slightly smaller than the dimensions of said CRT;

b) expanding the dimensions of said band by stretching said band utilizing stretching and forming means having a plurality of bosses and corresponding boss-receiving recesses associated therewith to form a plurality of outwardly directed concavities in said band to accommodate said base portion of each of said mounting lugs and to prevent the lateral displacement thereof;

c) securing said base portion to the overlying band;

d) heating said band so that the dimensions thereof exceed those of said CRT; and e) disposing said band around said sidewalls of said CRT.

2. The method recited in claim 1 further including in step b) the substep of:

positioning said concavities to overlie at least a portion of said corners of said sidewall, said base portion of each of said mounting lugs having an inner surface with a radius of curvature conforming to that of said corners of said sidewall.

3. The method recited in claim 2 further including the step of:

f) then allowing said band to contract and contact said given radius of curvature of the corners of said sidewall immediately adjacent each of said concavities to compressively force said base portion of each of said mounting lugs and said band against the corners of said sidewall to maximize the contact between said band and said sidewall.

4. The method recited in claim 1 further including in step b) the substep of:

positioning said concavities in the oppositely disposed long sides of said band to overlie a section of the flattened portions of said sidewall, said base portion of each of said mounting lugs having a substantially flat inner surface in contact with sidewall.

5. The method recited in claim 4 further including the step of:

f) then allowing said band to contract and contact said given radius of curvature of said corners and said sidewall immediately adjacent each of said concavities to compressively force said base portion of said mounting lugs and said band against the flattened portions of said sidewall.

6. The method recited in claim 1 further including in step b) the substep of:

positioning said concavities to overlie at least a portion of each of said corners and adjacent sections of the flattened portions of said sidewall along the long sides of said band, said base portion of each of said mounting lugs including a shoulder projection which substantially conforms to said given radius of curvature of the corners, said attachment portion of each of said lugs being located along the flattened portions of said sidewall.

7. The method recited in claim 6 further including the step of:

f) then allowing said band to contract and contact said given radius of curvature of said corners and said flattened portions of said sidewall immediately adjacent each of said concavities to compressively force said shoulder projection and said base portion of said mounting lug and said band against said corners and said flattened portions of said sidewall.

8. A method of forming a shrinkfit implosion protection band for a substantially rectangular CRT having a faceplate panel including a peripheral sidewall, said sidewall having corners with a given radius of curvature extending into flattened portions, a plurality of mounting lugs being disposed between said inner surface of said shrinkfit band and said sidewall, each of said mounting lugs having a base portion and an attachment portion, said method comprising the steps of a) forming said band by jointing together the ends of at least one strip of metal into a substantially rectangular loop having dimensions slightly smaller than the dimensions of said CRT;

b) expanding the dimensions of said band by stretching said band along the diagonals of a stretching and forming apparatus while contacting portions of said band with a plurality of bosses and forcing each of the contacted portions of said band into boss-receiving recesses, thereby forming a plurality of outwardly directed concavities in said band to accommodate said base portion of each of said mounting lugs and to prevent lateral displacement thereof;

c) securing said base portion of each of said mounting lugs to the overlying band;

d) heating said band so that the dimensions thereof exceed those of said CRT; and e) disposing said band around said sidewall of said CRT.

9. The method recited in claim 8 further including in step (b) the substep of:

positioning said concavities to overlie at least a portion of said corners of said sidewall, said base portion of each of said mounting lugs having an inner surface with a radius of curvature conforming to that of said corners of said sidewall.

10. The method recited in claim 9 further including the step of:

f) then allowing said band to contract and contact said given radius of curvature of the corners of said sidewall immediately adjacent each of said concavities to compressively force said base portion of each of said mounting lugs and said band against the corners of said sidewall to maximize the contact between said band and said sidewall.

11. The method recited in claim 8 further including in step b) the substep of:

positioning and concavities in the oppositely disposed along sides of said band to overlie a section of the flattened portions of said sidewalls, said base portion of each of said mounting lugs having a substantially flat inner surface in contact with sidewall.

12. The method recited in claim 11 further including the step of:

f) then allowing said band to contract and contact said given radius of curvature of said corners and said sidewall immediately adjacent each of said concavities to compressively force said base portion of said mounting lugs and said band against the flattened portions of said sidewall.

13. The method recited in claim 8 further including in step b) the substep of:

positioning said concavities to overlie at least a portion of each of said corners and adjacent sections of the flattened portions of said sidewall along the long sides of said band, said base portion of each of said mounting lugs including a shoulder projection which substantially conforms to said given radius of curvature of the corners, said attachment portion of each of said lugs being located along the flattened portions of said sidewall.

14. The method recited in claim 13 further including the step of:

f) then allowing said band to contract and contact said given radius of curvature of said corners and said flattened portions of said sidewall immediately adjacent each of said concavities to compressively force said shoulder projection and said base portion of said mounting lug and said band against said corners and said flattened portions of said sidewall.

* * * * *

UNITED STATES PATENT AND TRADEMARK OFFICE

CERTIFICATE OF CORRECTION

PATENT NO. : 5,064,394

DATED : Nov. 12, 1991

INVENTOR(S) : Harry R. Swank

It is certified that error appears in the above-identified patent and that said Letters Patent is hereby corrected as shown below:

Patent

Col. 5, line 13, delete "20".

Col. 5, line 49, change "10" to --110--.

Col. 6, line 18, delete "20".

Signed and Sealed this

Sixteenth Day of March, 1993

*Attest:*

STEPHEN G. KUNIN

*Attesting Officer*

*Acting Commissioner of Patents and Trademarks*